US011889967B2

(12) United States Patent
Garcia et al.

(10) Patent No.: US 11,889,967 B2
(45) Date of Patent: Feb. 6, 2024

(54) SLIDING-PIVOTING MECHANISM FOR A SHELF OF A PIECE OF FURNITURE OR HOUSEHOLD APPLIANCE, AND PIECE OF FURNITURE OR HOUSEHOLD APPLIANCE

(71) Applicant: PAUL HETTICH GMBH & CO. KG, Kirchlengern (DE)

(72) Inventors: Oscar Garcia, San Sebastian (ES); Ander Martinez, Donostia (ES); Patrick Bon, Horgen (CH); Thomas Wieder, Stetten (FR)

(73) Assignee: Paul Hettich GmbH & Co. KG, Kirchlengern (DE)

( * ) Notice: Subject to any disclaimer, the term of this patent is extended or adjusted under 35 U.S.C. 154(b) by 358 days.

(21) Appl. No.: 17/441,339

(22) PCT Filed: Mar. 4, 2020

(86) PCT No.: PCT/EP2020/055684
§ 371 (c)(1),
(2) Date: Sep. 21, 2021

(87) PCT Pub. No.: WO2020/193094
PCT Pub. Date: Oct. 1, 2020

(65) Prior Publication Data

US 2022/0160206 A1 May 26, 2022

(30) Foreign Application Priority Data

Mar. 22, 2019 (DE) ..... 10 2019 107 389.8

(51) Int. Cl.
*A47L 15/50* (2006.01)
*A47B 96/07* (2006.01)
*A47B 88/90* (2017.01)

(52) U.S. Cl.
CPC ..... *A47L 15/506* (2013.01); *A47B 96/07* (2013.01); *A47L 15/507* (2013.01); *A47B 2088/901* (2017.01)

(58) Field of Classification Search
CPC ..... A47L 15/506; A47B 2088/901; A47B 46/005
See application file for complete search history.

(56) References Cited

U.S. PATENT DOCUMENTS 9,420,882 B2 8/2016 Garcia et al.
2015/0305493 A1* 10/2015 Garcia ..... A47B 46/005 248/240.4

(Continued)

FOREIGN PATENT DOCUMENTS

DE 102018111657 A1 2/2019
EP 2890271 B1 10/2016

(Continued)

OTHER PUBLICATIONS

International Search Report dated Apr. 21, 2020 in related/corresponding International Application No. PCT/EP2020/055684.

(Continued)

*Primary Examiner* — Spencer E. Bell
(74) *Attorney, Agent, or Firm* — PATENT PORTFOLIO BUILDERS PLLC

(57) ABSTRACT

A sliding-pivoting mechanism of a shelf of a piece of furniture or household appliance includes two pivot arms pivotally secured to a body and forming a parallel guide for a pull-out guide having at least one guide rail and a running rail. A locking mechanism is arranged on the guide rail and on one of the pivot arms for preventing a simultaneous pivoting and sliding movement. The locking mechanism has a locking pin moveably arranged on one of the pivot arms, and a locking plate mounted stationarily relative to the guide rail and with which the locking pin cooperates in such a way that a pivoting of the pivot arm is blocked when the shelf is (Continued)

Figure 1:
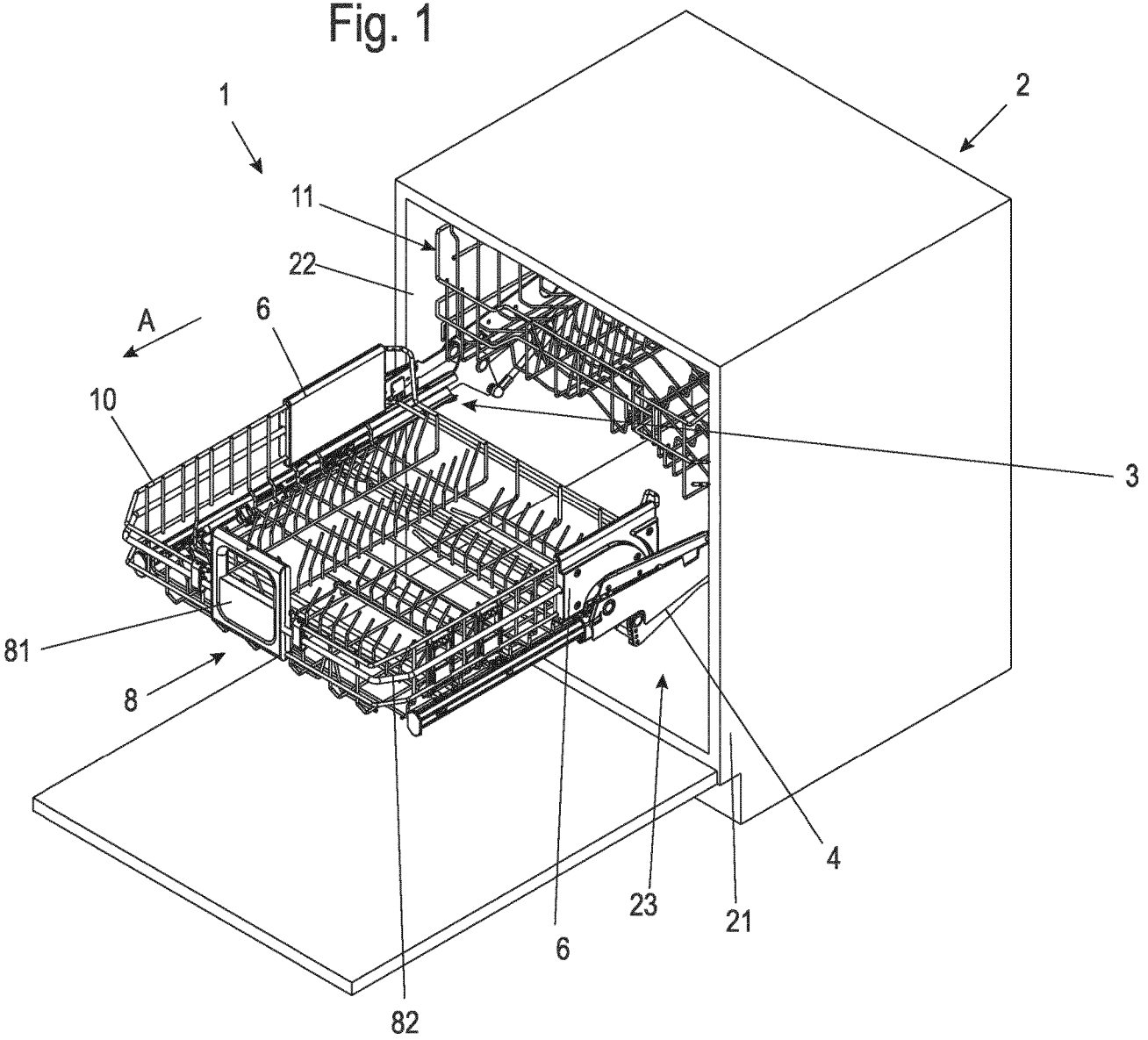

raised into an upper loading and unloading position. An unlocking device is coupled to the locking mechanism and includes an actuation element and an unlocking element, with which the locking pin can be moved out of a blocking position into a release position.

19 Claims, 9 Drawing Sheets

(56) References Cited

U.S. PATENT DOCUMENTS

| | | | | |
|---|---|---|---|---|
| 2017/0164733 | A1* | 6/2017 | Azkue | F24C 15/16 |
| 2017/0181538 | A1* | 6/2017 | Azkue | A47B 46/005 |

FOREIGN PATENT DOCUMENTS

| | | | |
|---|---|---|---|
| WO | 2019030067 | A1 | 2/2019 |
| WO | 2019219432 | A1 | 11/2019 |

OTHER PUBLICATIONS

Search Report created Jan. 10, 2020 in related/corresponding DE Application No. 10 2019 107 389.8.
Written Opinion dated Apr. 21, 2020 in related/corresponding International Application No. PCT/EP2020/055684.

* cited by examiner

SLIDING-PIVOTING MECHANISM FOR A SHELF OF A PIECE OF FURNITURE OR HOUSEHOLD APPLIANCE, AND PIECE OF FURNITURE OR HOUSEHOLD APPLIANCE

BACKGROUND AND SUMMARY OF THE INVENTION

Exemplary embodiments of the present invention relate to a sliding-pivoting mechanism for a shelf of a piece of furniture or household appliance for pulling out and raising the shelf from a body of the piece of furniture or household appliance, as well as to a piece of furniture or household appliance.

A generic sliding-pivoting mechanism for a shelf of a piece of furniture or household appliance is known, for example, from EP 2 890 271 B1.

Such sliding-pivoting mechanisms can be used, for example, in furniture or household appliances such as dishwashers, refrigerators, freezers or cooking appliances in order to be able to pull a shelf, for example in the form of a drawer, dish rack, container or cooking product carrier, out of the interior of the furniture or household appliance and lift it upwards. In the raised position of the shelf, loading or unloading of the shelf is convenient for the user.

In practice, such sliding-pivoting mechanisms have proven their worth. In particular, the locking of this sliding-pivoting mechanism, which prevents simultaneous sliding movement of the running rail and pivoting movement of the pivot arms, ensures reliable operation of the sliding-pivoting mechanism as well as a secured raised position of the shelf in which the user can conveniently load or unload it.

A disadvantage of the sliding-pivoting mechanism described in the above-mentioned publication is that a locking pin of a locking mechanism, with which the shelf is secured in the upper loading and unloading position, is briefly subjected to a large part of the weight of the shelf together with the load for unlocking, since the locking pin must be lifted out of its locking position, in a vertical locking groove, for unlocking.

Exemplary embodiments of the present invention are directed to a sliding-pivoting mechanism for a shelf of a piece of furniture or household appliance, with which the unlocking of the shelf from the upper loading and unloading position can be performed even more easily and, in particular, the locking pin of the locking mechanism is relieved.

The sliding-pivoting mechanism according to the invention has at least two pivot arms that can be pivotally fixed to the body and are arranged parallel to one another, forming a parallel guide for a pull-out guide.

The pull-out guide has at least one guide rail and a running rail, which can be moved relative to the guide rail and to which the shelf is attached.

The sliding-pivoting mechanism further has a locking mechanism arranged on the guide rail and on one of the pivot arms to prevent simultaneous pivoting and sliding movement.

The locking mechanism has a locking pin movably arranged on one of the pivot arms and a locking plate that is mounted stationary to the guide rail and with which the locking pin cooperates in such a way that pivoting of the pivot arms is blocked when the shelf is raised to an upper loading and unloading position.

The sliding-pivoting mechanism further comprises an unlocking device coupled to the locking mechanism and having an actuating element and an unlocking element for moving the locking pin from a locking position to a release position.

The actuating element is designed as a handle that can be tilted about a horizontal pivot axis and is coupled to the unlocking element via a connecting lever.

With such a sliding-pivoting mechanism, it is possible in a simple manner to release the locking of the shelf from the upper loading and unloading position by actuating the actuating element of the unlocking device.

According to an advantageous embodiment variant, the unlocking element is designed as an L-shaped lever rotatably arranged on the connecting lever with a first leg and a second leg aligned at an angle to the first leg, wherein the locking pin can be pressed out of a locking groove of the locking plate by tilting the unlocking element with the first leg.

Alternatively, the unlocking element is designed as a U-shaped lever rotatably arranged on a guide adapter and having a first leg and a second leg connected to the first leg via a base, wherein the locking pin can be pressed out of a locking groove of the locking plate by tilting the unlocking element with a tongue extending from the base.

On the one hand, such a tiltable handle makes it easy to pull out and push in the shelf and, at the same time, allows the release element to be pulled out and actuated almost simultaneously.

The design of the unlocking element as an L-shaped lever allows a simple linear, in particular horizontal, movement of the connecting lever to which the L-shaped lever is coupled and thus a simple conversion of the movement of the connecting lever into a lifting of the locking pin required perpendicularly thereto.

According to an advantageous further development, the guide element is fixed to the second pivot lever and, when a pivoting movement is performed, the pivot lever can be guided along a guide groove of a guide adapter attached to the shelf.

According to a further advantageous further development, the unlocking element is held at the crossing point of the two legs of the lever via a pivot joint on the connecting lever.

This allows linear movement of the pivot joint when the actuating element is operated.

According to a further advantageous design, a web extending at an angle to a section of the connecting lever extending along a side surface of the shelf is arranged on the connecting lever, on which web the pivot joint of the unlocking element designed as an L-shaped lever is held, whereby the unlocking element can be brought into the desired vertical position in a simple configuration.

The second leg is preferably coupled to a retaining element fixed to the guide adapter or the shelf in such a way that the legs can be rotated about the pivot joint during an unlocking movement of the connecting lever in which the pivot joint is moved linearly. The further out the point of engagement of the retaining element, preferably in the form of a stop, is on the second leg, viewed relative to the pivot joint, the less force is opposed to actuation of the unlocking element.

According to an advantageous further development of the embodiment variant having the U-shaped lever, the unlocking element is held stationary at the base near the first leg via a pivot joint, but rotatably on the guide adapter.

According to a further advantageous design, a retaining bolt is arranged at a free end of the first leg and is coupled to the web of the connecting lever in such a way that the unlocking element is tilted about the pivot joint into its unlocking position during an unlocking movement of the connecting lever.

To substantially prevent unintentional unlocking, the unlocking device is spring-loaded and held in the basic position.

In particular, a spring element held on the connecting lever is held with its other end on the guide adapter, wherein the spring force of the spring element counteracts a movement of the connecting lever out of the basic position.

The arrangement of such a spring element between the connecting lever and the guide adapter represents an extremely simple and cost-effective means of securing the unlocking device in the locking position.

According to a further embodiment variant, in order to limit the tilting movement of the actuating element, the connecting lever, which is aligned parallel to the pivot axis of the actuating element, is held by at least one clip fastened to a web of the shelf.

The clip enables a guided pivoting movement of the connecting lever about an axis parallel to the pivot axis of the actuating element.

The piece of furniture or household appliance according to the invention, comprising a body and at least one shelf guided in the body by a sliding-pivoting mechanism, is characterized by a sliding-pivoting mechanism as described above.

In the event of a household appliance designed as a dishwasher, the rack is preferably designed as a dish rack.

BRIEF DESCRIPTION OF THE DRAWING FIGURES

Figure 2:
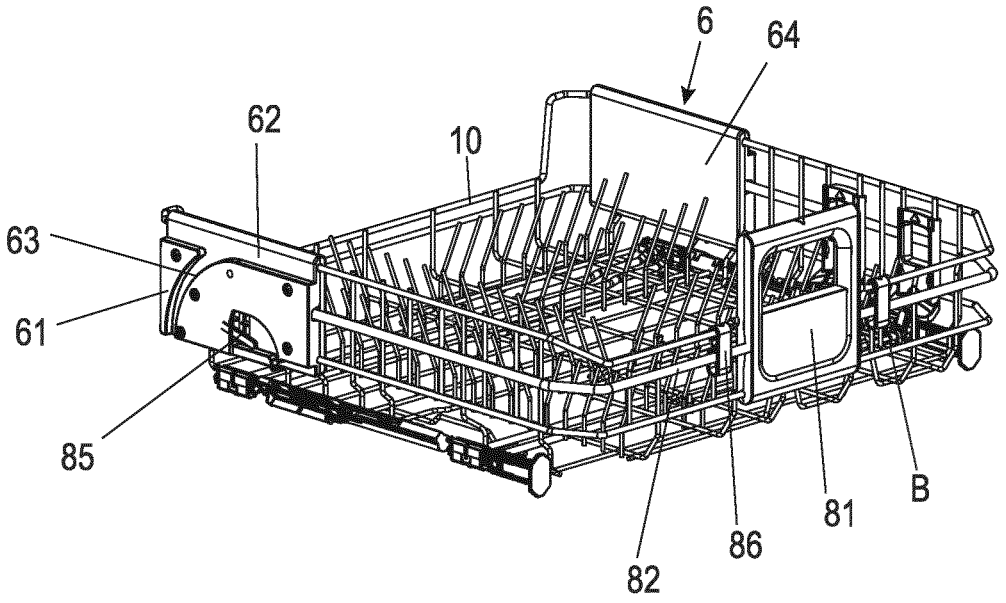
Figure 3:
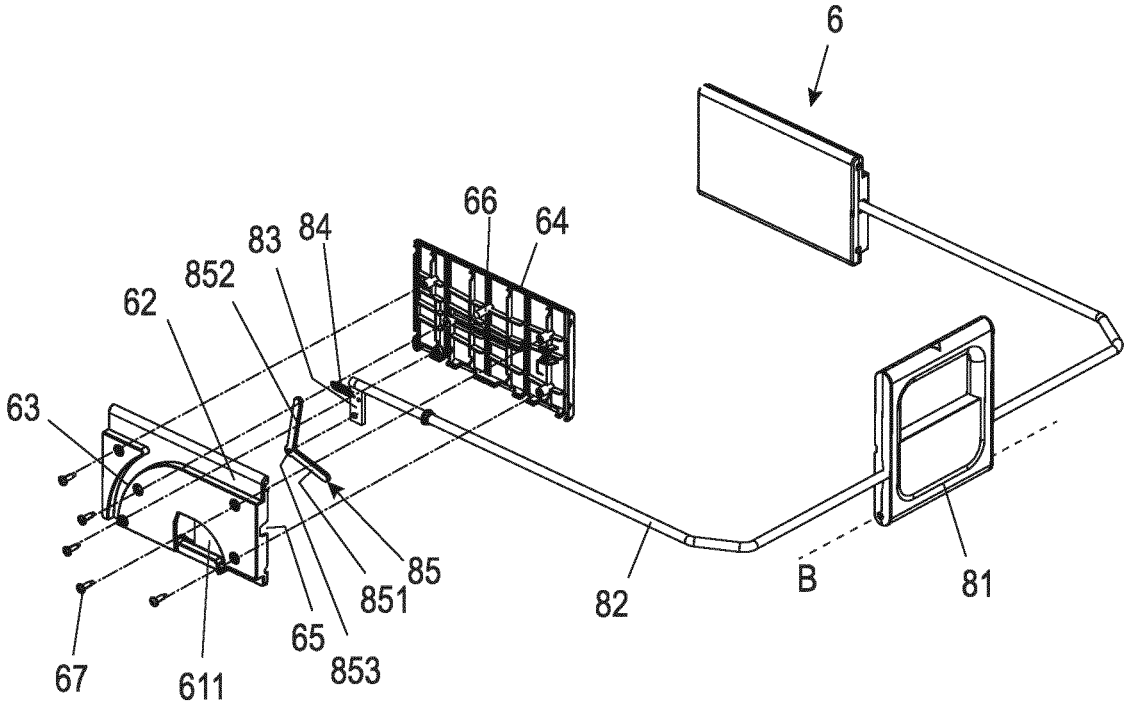

In the following, preferred embodiment variants of the invention are explained in more detail with reference to the accompanying drawings, wherein:

FIG. 1 shows an isometric view of a dishwashing machine having an upper dish rack and a lower dish rack guided by a sliding-pivoting mechanism, which is in a raised and extended position, FIG. 2 shows a perspective view of the lower dish rack with the running rail, release device and guide adapter attached to it, FIG. 3 shows a partial exploded view of the unlocking device and the guide adapter according to FIG. 2.

Figure 4:
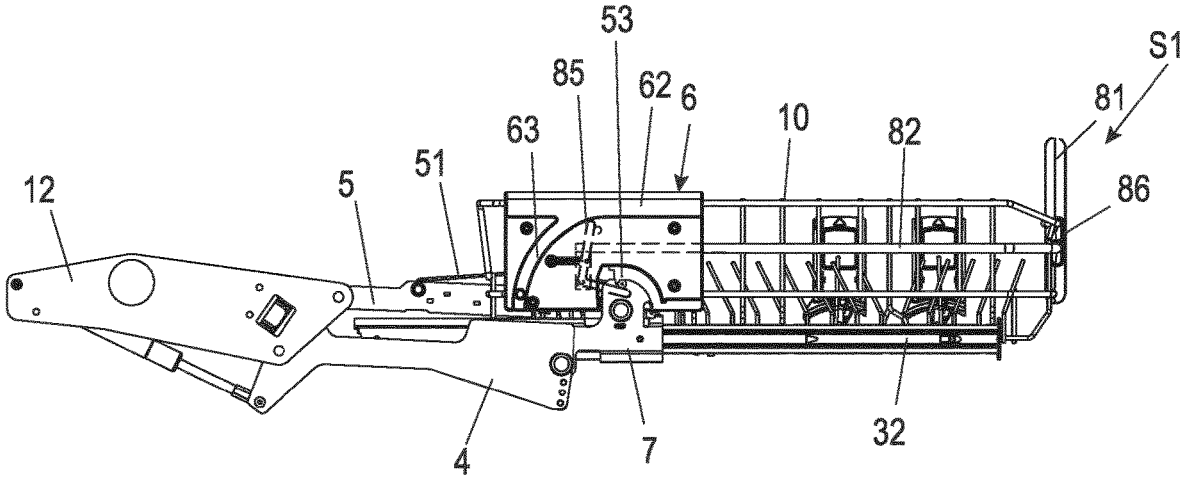
Figure 5:
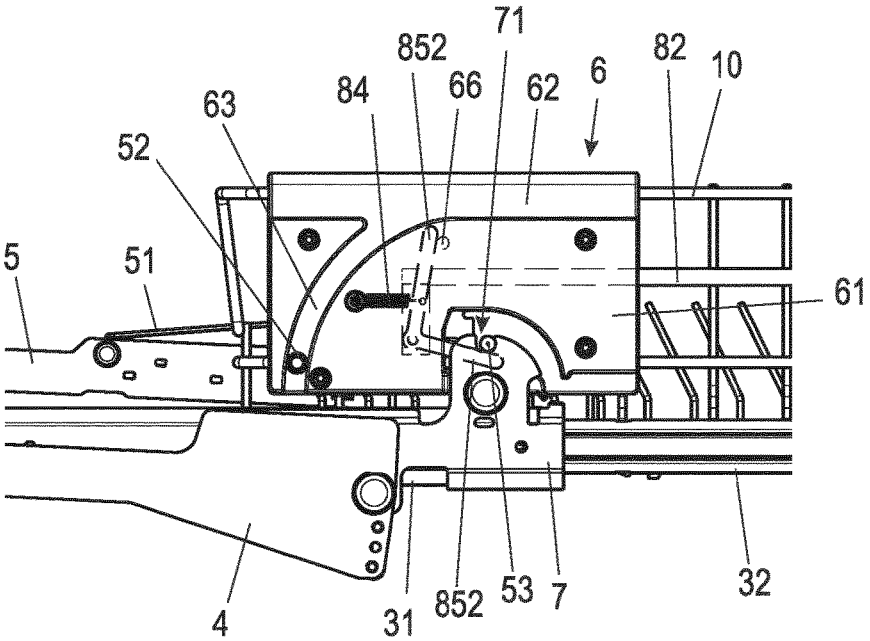
Figure 6:
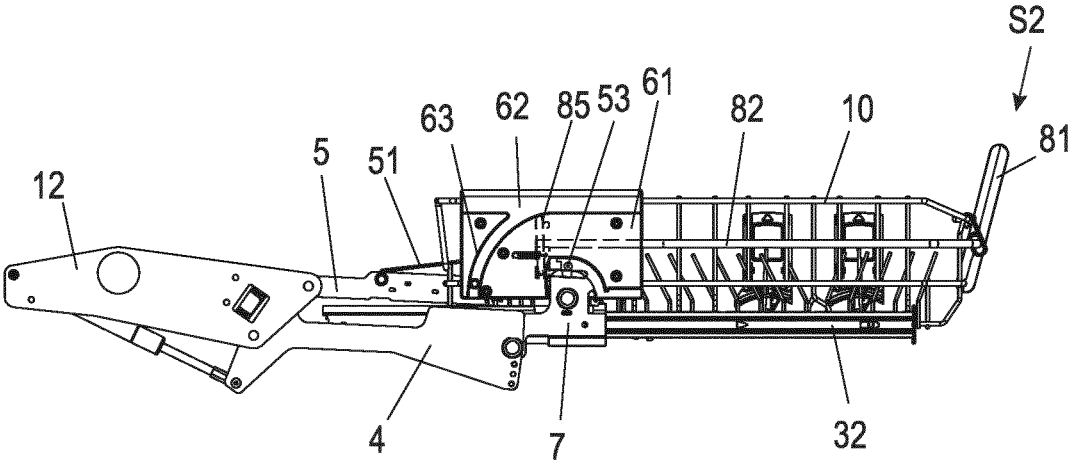
Figure 7:
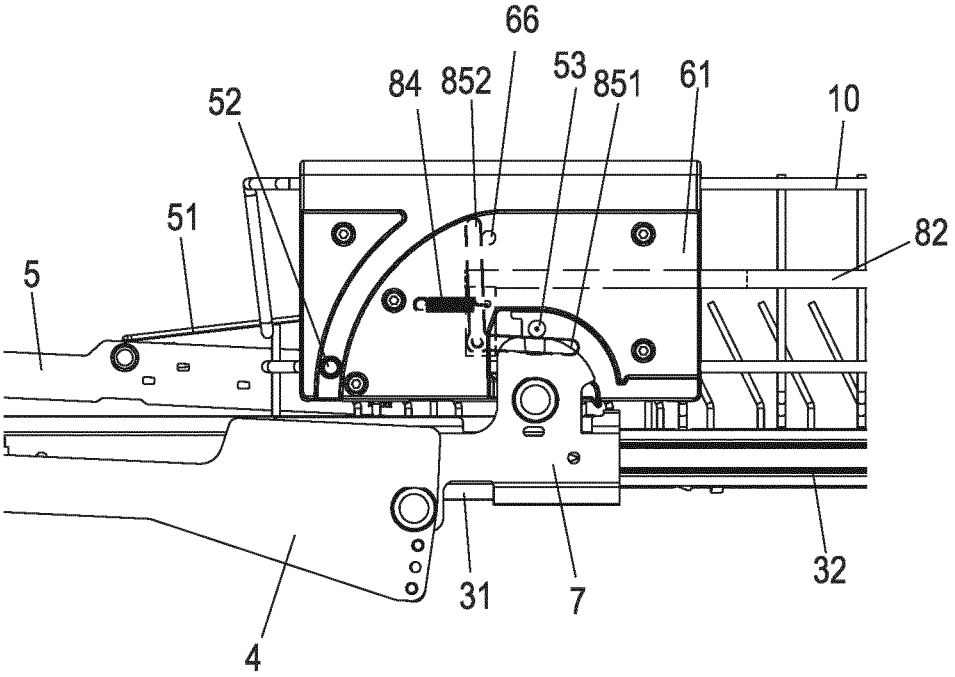
Figure 8:
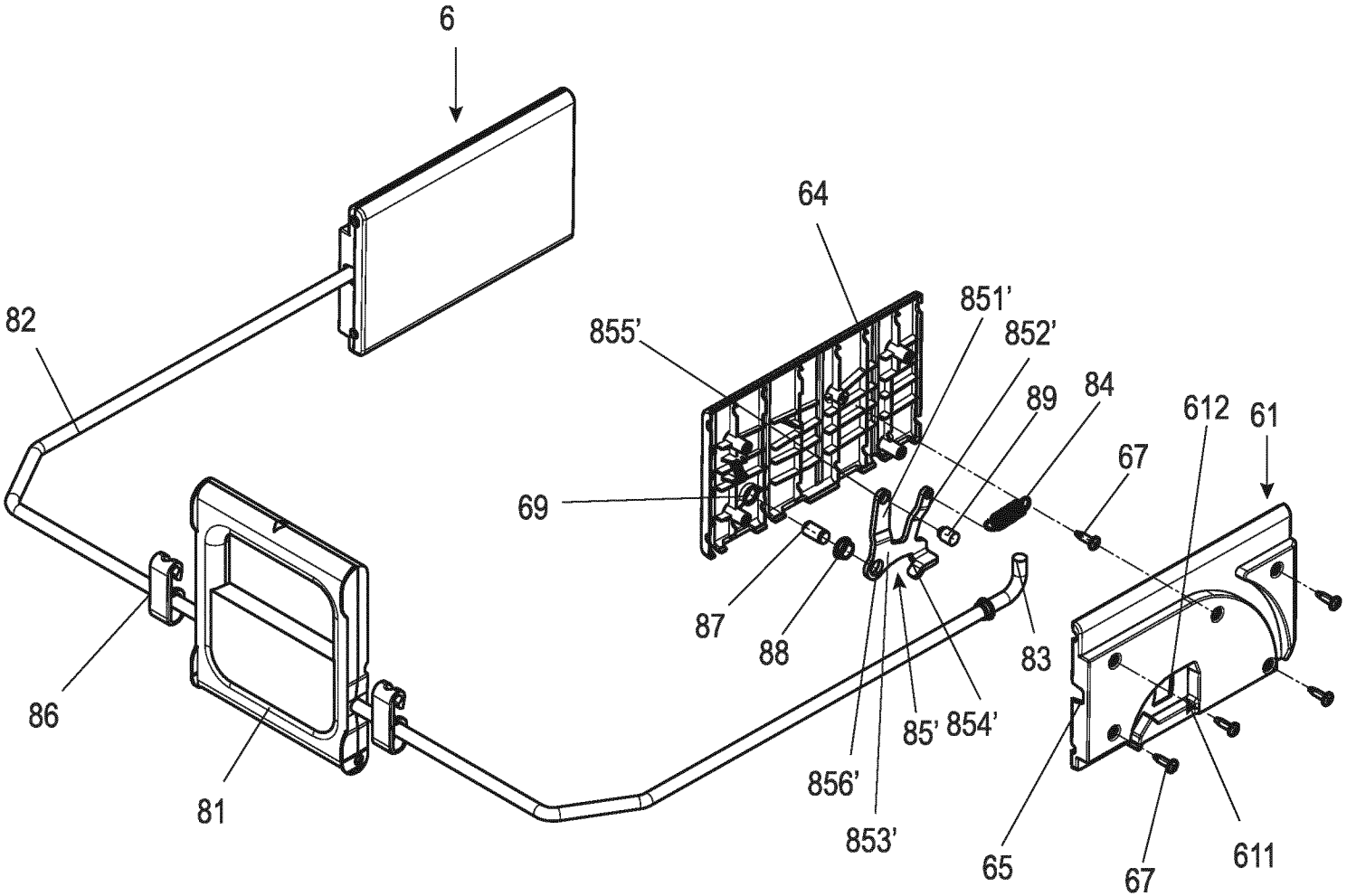
Figure 9:
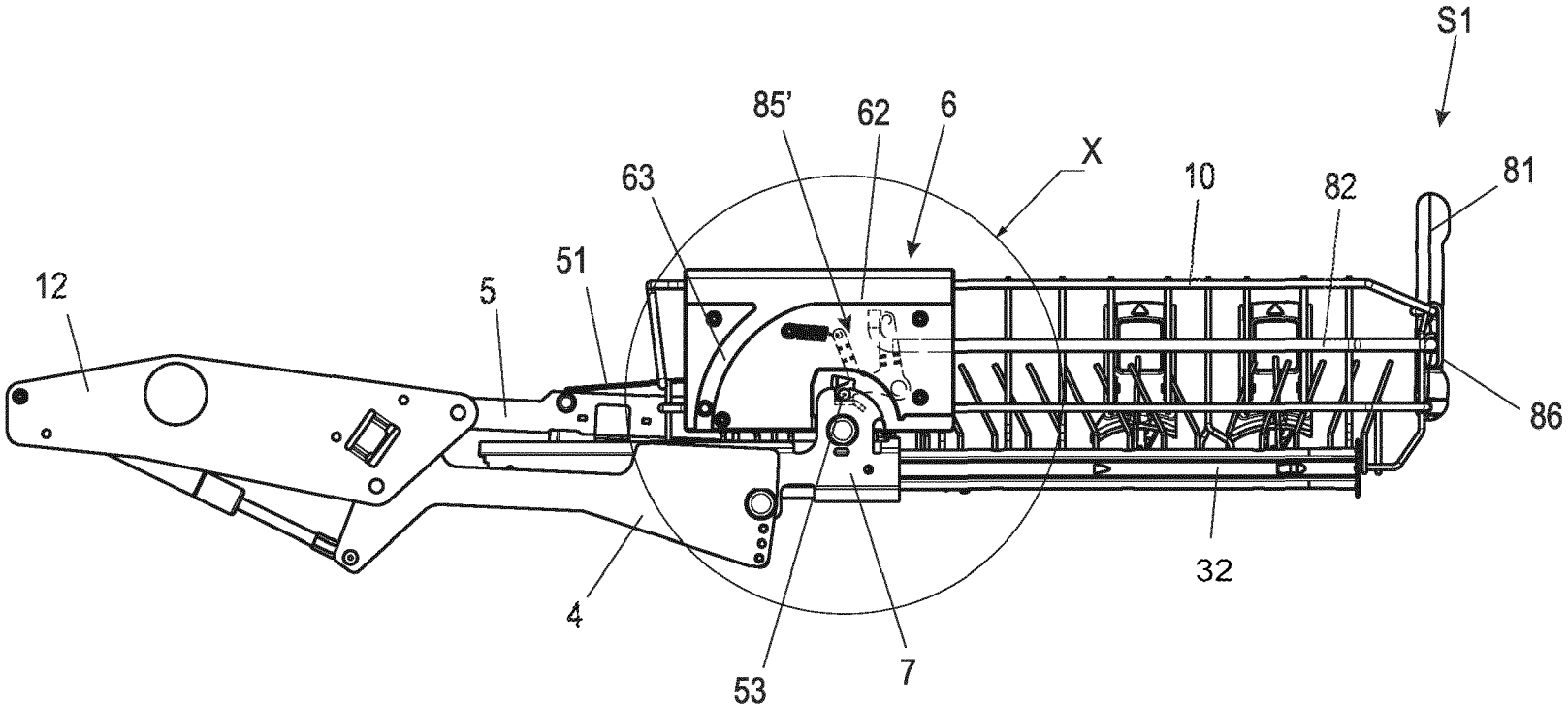
Figure 10:
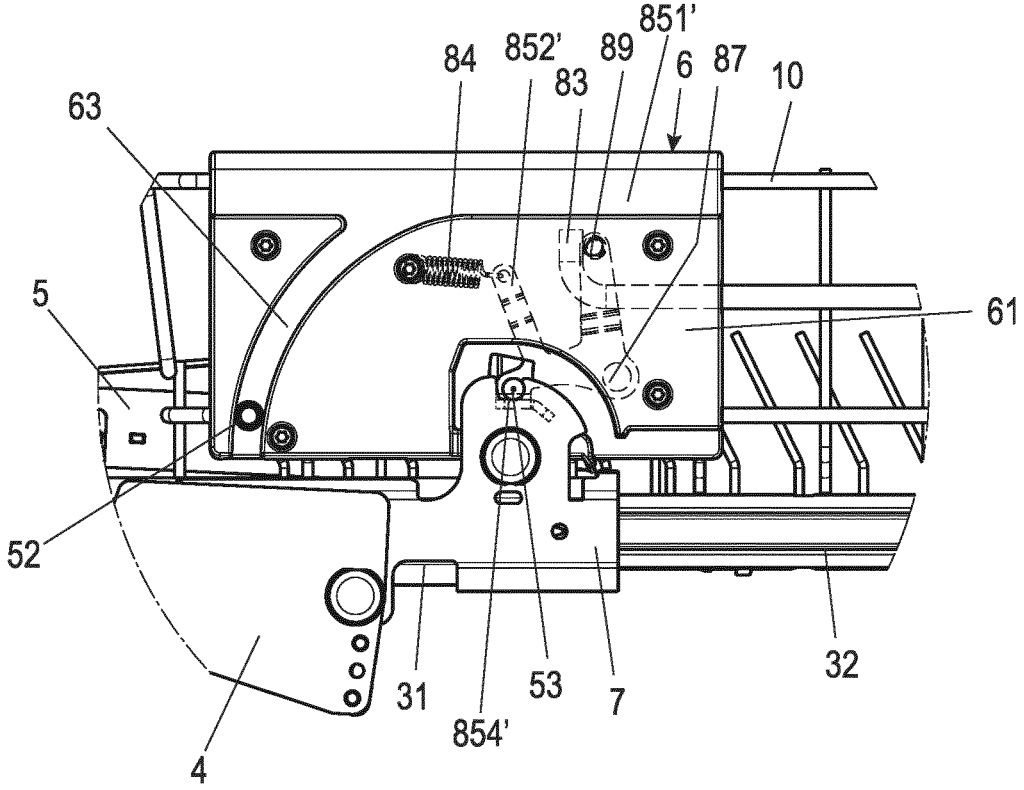
Figure 11:
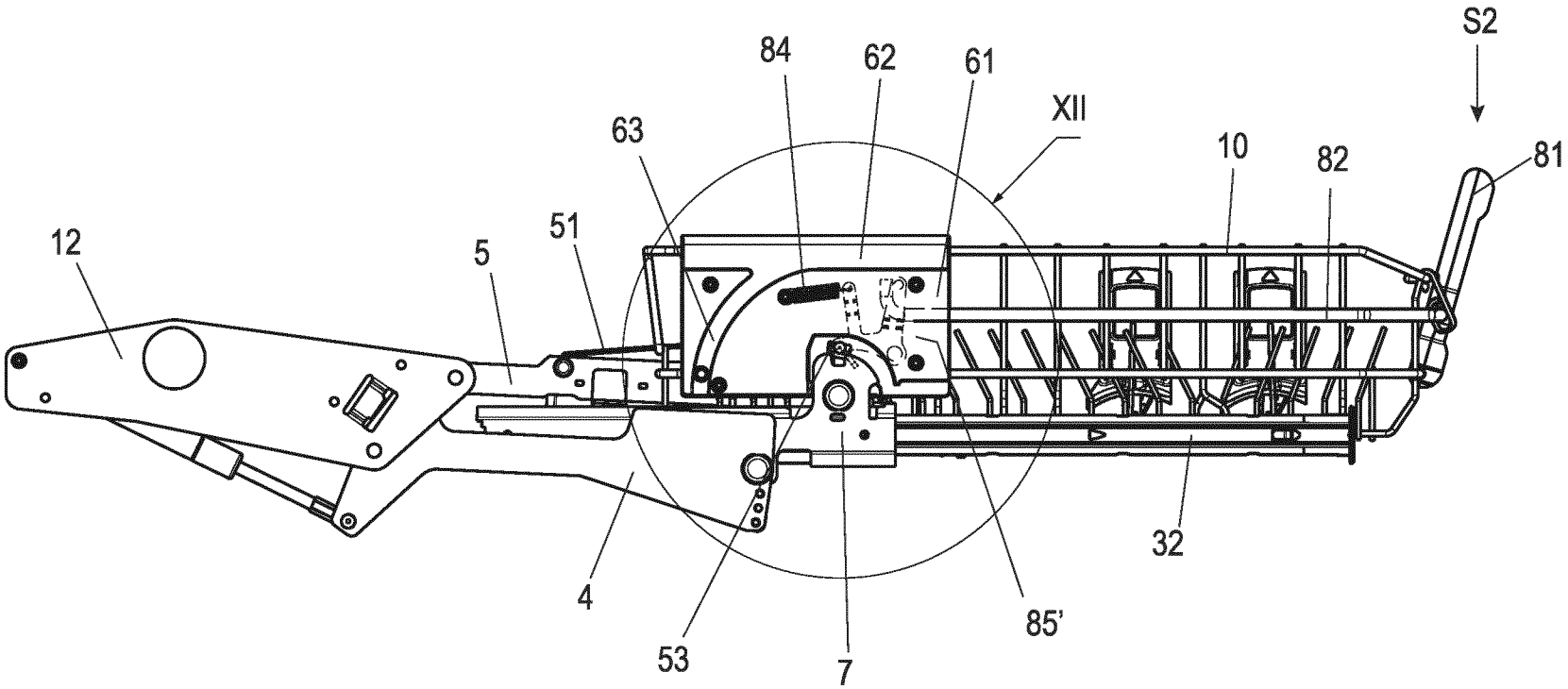
Figure 12:
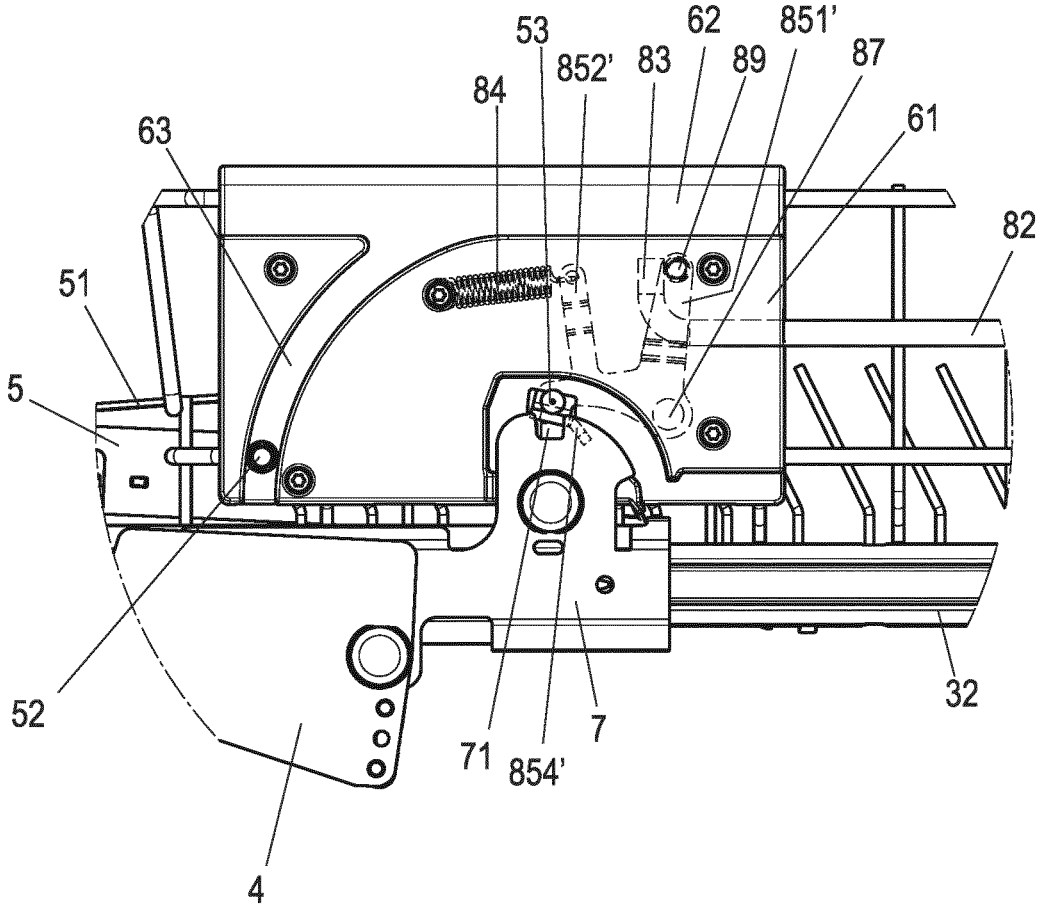

FIG. 4 shows a side view of the lower dish rack with sliding-pivoting mechanism arranged thereon in an upper loading and unloading position in the position secured by the locking pin, FIG. 5 shows a sectional enlargement of a section shown in FIG. 4 to show the locking pin and the unlocking element in more detail, FIGS. 6 and 7 show illustrations corresponding to FIGS. 4 and 5, in which the locking pin is lifted out of its locking position, FIG. 8 shows a partial exploded view of an alternative embodiment variant of the unlocking device and the guide adapter, FIG. 9 shows a side view of the lower dish rack with the running rail attached to it and the unlocking device and guide adapter shown in FIG. 8 in an upper loading and unloading position in the position secured by the locking pin, FIG. 10 shows a sectional enlargement of a section shown in FIG. 9 to show the locking pin and the unlocking element in more detail, FIGS. 11 and 12 show illustrations corresponding to FIGS. 9 and 10, in which the locking pin is lifted out of its locking position.

DETAILED DESCRIPTION

In the following description of figures, terms such as top, bottom, left, right, front, rear, etc. refer exclusively to the exemplary representation and position of the sliding-pivoting mechanism, the shelf, the pivot arms, the locking pin, the locking plate, the unlocking element, the guide element, the support element, and the like selected in the respective figures. These terms are not to be understood restrictively, i.e., different working positions or the mirror-symmetrical design or the like can change these references.

In FIG. 1, the reference numeral 1 indicates a household appliance, here in the form of a dishwasher. Two shelves 10, 11, here in the form of dish racks, are mounted in the dishwashing compartment of the dishwasher. The lower shelf 10 is connected to the body on both sides via, in each case, one embodiment variant of a sliding-pivoting mechanism according to the invention. With such a sliding-pivoting mechanism, it is possible in a simple manner to pull out and lift up the lower shelf 10 from a body 2 of the household appliance 1 or of a piece of furniture.

The sliding-pivoting mechanism comprises at least two pivot arms 4, 5 that can be pivotally fixed to the body 2 and are arranged parallel to each other, forming a parallel guide for a pull-out guide 3.

The pivot arms 4, 5 are preferably fixed in place by means of a side wall mounting 12, as shown for example in FIG. 4. Each of the pivot arms 4, 5 is pivotally connected to the side wall mounting 12 by a pivot joint.

It is also conceivable to fix the pivot arms 4, 5 directly to a side wall 21, 22 of the body 2 of the furniture or household appliance 1.

The pull-out guide 3 has at least one guide rail 31 and a running rail 32 that can be moved relative to the guide rail 31. The shelf 10 is attached to the guide rail 32.

It is also conceivable to arrange a center rail between the guide rail 31 and the running rail 32, which can be moved relative to the guide rail 31 and the running rail 32 and thus ensures an over-extension of the pull-out guide 3.

With the aid of the pull-out guide 3 and the pivot arms 4, 5, a lifting or lowering movement of the shelf 10 from a lower position to an upper loading and unloading position is possible in a manner known per se, as explained, for example, in the above-mentioned EP 2 890 271 B1.

The pull-out guide 3 allows the shelf to be pulled out of or pushed into the interior 23 of the body 2. For a description of the movement sequence, reference is expressly made to EP 2 890 271 B1, the description of which is expressly referred to here.

To prevent simultaneous pivoting and sliding movement of the sliding-pivoting mechanism, the sliding-pivoting mechanism comprises a locking mechanism arranged on the guide rail 31 and, in the present case, on the first pivot arm 4. A partial arrangement of the locking mechanism on the second pivot arm 5 is also conceivable.

As shown in FIGS. 4 to 12, this locking mechanism comprises a locking pin 53 arranged on the pivot arm 5, in this case on a web 51 pivotally held on the pivot arm 5, and a locking plate 7 having a locking groove 71 extending vertically from an upper edge into the locking plate 7, in which the locking pin 53 can be locked in the upper loading and unloading position, as shown for example in FIG. 4.

The locking plate 7 is mounted stationary on the guide rail 31. Furthermore, the ends of the pivot arms 4, 5 are held at respective pivot joints on this locking plate 7.

For unlocking the locking pin 53 from this locking groove 71 in the locking plate 7, the sliding-pivoting mechanism comprises an unlocking device 8 coupled to the locking mechanism, having an actuating element 81 and an unlocking element 85, 85', with which the locking pin 53 can be moved from the locking position described above into a release position.

As shown in FIGS. 3 and 8, the unlocking device 8 has an actuating element 81 that is preferably designed as a handle.

Connecting levers 82 are provided on both sides of the actuating element 81 parallel to the web of the actuating element 81, which is formed as a handle and can be grasped by the hand of a user.

The connecting levers 82 are fixedly connected to the actuating element 81 and extend from side edges of the actuating element 81 projecting along a front side of the shelf 10.

The connecting levers 82 are guided laterally around the side surfaces of the shelf 10 via angle pieces and end in respective guide adapters 6 arranged on both sides of the shelf 10. In the exemplary embodiment shown here, the connecting levers 82 are guided in corresponding guide grooves 65 in the guide adapters 6.

The actuating element 81, which is designed as a handle, has at its lower end a receptacle for a pivot axis B about which the actuating element 81 can be pivoted, as shown for example in FIGS. 4, 6, 9 and 11, from a vertical switching position S1 (FIGS. 4, 9) into a switching position S2 (FIGS. 6, 11) that is inclined in the pull-out direction A. The pivot axis B is preferably designed as a section of the shelf 10.

The guide adapter 6 has a first housing part 61 and a second housing part 64, which can be fixed to one another by fastening elements 67.

A section of a side wall of the shelf 10 is clamped between the first housing part 61 and the second housing part 64.

Furthermore, respective ends of the unlocking device 8 are also accommodated between the housing parts 61, 64.

Guide channels 62, 63 are formed on an outer side of the first housing part 61 facing away from the second housing part 64.

In each of these guide channels 62, 63, a guide element 52 fixed to the second pivot arm 5 can be guided in such a way that, in the lowered position of the shelf 10, when the shelf 10 is pulled out into the lower pivoting position, the guide element 52 is guided along the rectilinear guide channel 62 and, during the pivoting movement of the pivot arms 4, 5, is guided along or in the second guide channel 63, which is in the form of a circular section.

A first embodiment variant of the unlocking device 8 is described below with reference to FIGS. 3 to 7.

As shown in FIG. 3, in the area of the end of the unlocking device 8 accommodated in the guide adapter 6, a retaining web extends vertically downward, to which an unlocking element 85 is fixed.

The unlocking element 85 is preferably designed as an L-shaped lever rotatably arranged on the connecting lever 82 with a first leg 851 and a second leg 852 aligned at an angle to the first leg 851.

The locking pin 53 can be pushed out of the locking groove 71 of the locking plate 7 by tilting the unlocking element 85 with the first leg 851.

As further shown in FIG. 3, the unlocking element 85 is held at the intersection of the two legs 851, 852 by means of a pivot joint 853 on the connecting lever 82.

In order to position the first leg 851 below the locking pin 53, a web 83 extending at an angle to a section of the connecting lever 82 extending along a side surface of the shelf 10 is arranged on the connecting lever 82, at the free end of which web the pivot joint 853 of the unlocking element 85, which is designed as an L-shaped lever, is held.

The second leg 852 is coupled to a retaining element 66 fixed to the guide adapter 6 in the illustrated embodiment variant, in such a way that during an unlocking movement of the connecting lever 82, during which the pivot joint 853 is moved linearly, the legs 851, 852 rotate about the pivot joint 853, so that during this rotational movement the first leg 851 pushes the locking pin 53 out of the locking groove 71, as can be seen clearly in FIG. 7.

It is also conceivable to fix the retaining element 66 to the shelf 10.

In the embodiment variant shown, the retaining element 66 is designed as a stop, in particular a stop bolt. However, other shapes of the retaining element 66 are also conceivable.

Furthermore, the unlocking device 8 is held in the locking position under spring load. For this purpose, as shown in FIG. 3, a spring element 84 held on the connecting lever 82 is held on the guide adapter 6.

The spring force of this spring element 84, which is designed here as a helical tension spring, counteracts a movement of the connecting lever 82 out of the locking position.

FIGS. 4 and 5 show the arrangement shown in FIGS. 2 and 3 in a locked position of the locking pin 53 in the upper loading and unloading position of the shelf 10.

As can be seen in particular in FIG. 5, the locking pin 53 here engages in the locking groove 71 of the locking plate 7.

In this position, the first leg 851 of the unlocking element 85 rests against the locking pin 53 from below due to the positioning of the actuating element 81 in the switching position S1.

If the shelf 10 is now to be pivoted from its upper loading and unloading position back to a lower position, the actuating element 81 is pivoted in pull-out direction A for this purpose.

In this case, the part of the connecting lever 82 guided along the side surfaces of the shelf 10 is displaced by a first switching dimension in the pull-out direction A. This position is shown in FIGS. 6 and 7.

As can be clearly seen in FIG. 6, the actuating element 81, which is designed as a handle, is pivoted through an angle from its vertical locking position, the first switching position S1, into a release position, the second switching position S2, which is inclined here through an acute angle. The associated displacement of the connecting lever 82 in the pull-out direction causes the pivot joint 853 to move linearly with the connecting lever 82 in the pull-out direction.

The contact of the second leg 852 with the retaining element 66 positioned in front of the connecting lever 82 in the direction of movement of the latter results in a rotation of the unlocking element 85 about the axis of rotation 853, during which the first leg 851 pivots upwards and thereby presses the locking pin upwards out of the locking groove 71.

A second embodiment variant of the unlocking device 8 is described below with reference to FIGS. 8 to 12.

In contrast to the first embodiment variant of the unlocking device 8 described above, the unlocking element 85', as shown in FIGS. 8, 10 and 12, is designed as a U-shaped lever rotatably arranged on a guide adapter 6 and having a first leg 851' and a second leg 852' connected to the first leg 851' via a base 853'.

From the base 853' of the unlocking element 85', a tongue 854' preferably extends parallel to an axis of rotation of the unlocking element 85' through a window 612 of the first housing part 61 into a recess 611 of the first housing part 61, in which the locking pin 53 is guided.

By tilting the unlocking element 85' from the locking position about a bolt 87 serving as a pivot joint, which is arranged, in particular fastened, in a bolt receptacle 69 of the second housing part 64, into a release position, the locking pin 53 is pressed out of the locking groove 71 of the locking plate 7.

As can be seen in FIG. 8, the bolt 87 is rotatably attached to the base 853' of the unlocking element 85' in a joint receptacle 856' provided for this purpose near the first leg 851'. Preferably, for this purpose, a rotating cap 88 is placed on an end of the bolt 87 facing away from the second housing part 64 and is received in the joint receptacle 856'. In this way, the unlocking element 85' is held stationary but rotatably on the guide adapter 6 via the bolt 87 serving as a pivot joint.

In order to cause a rotation of the unlocking element 85' when the actuating element 81, which is designed as a handle, is moved from the first switching position S1 to the second switching position S2 as shown in FIG. 9, a retaining bolt 89 is arranged at a free end of the first leg 851' in a retaining bolt receptacle 855', which is coupled to the web 83 of the connecting lever 82 in such a way that, during an unlocking movement of the connecting lever 82 in the pull-out direction A, the unlocking element 85' is rotated or tilted about the bolt 87, which serves as a pivot joint, into its unlocking position.

The tilting is accompanied by a lifting of the tongue 854' which engages under the locking pin 53, so that the locking pin 53 is moved out of the locking groove 71 of the locking plate 7.

In this embodiment variant, too, the unlocking device 8 is held in the locking position under spring load. For this purpose, as shown in FIG. 8, a spring element 84 held on the second housing part 64 is held on a retaining bolt 89 arranged on the second leg 852' of the unlocking element 85'.

The spring force of this spring element 84, which is designed here as a helical tension spring, counteracts a movement of the unlocking element 85' and thus also of the connecting lever 82 out of the locking position.

As can be seen in FIGS. 2, 4, 6 and 8, in order to limit the pivoting movement of the actuating element 81, the connecting lever 82 is held parallel to the pivot axis B of the actuating element 81 by at least one clip 86 attached to a web of the shelf 10.

In the embodiment variants shown here, one such clip 86 is arranged on each side of the actuating element 81.

Although the invention has been illustrated and described in detail by way of preferred embodiments, the invention is not limited by the examples disclosed, and other variations can be derived from these by the person skilled in the art without leaving the scope of the invention. It is therefore clear that there is a plurality of possible variations. It is also clear that embodiments stated by way of example are only really examples that are not to be seen as limiting the scope, application possibilities or configuration of the invention in any way. In fact, the preceding description and the description of the figures enable the person skilled in the art to implement the exemplary embodiments in concrete manner, wherein, with the knowledge of the disclosed inventive concept, the person skilled in the art is able to undertake various changes, for example, with regard to the functioning or arrangement of individual elements stated in an exemplary embodiment without leaving the scope of the invention, which is defined by the claims and their legal equivalents, such as further explanations in the description.

LIST OF REFERENCE NUMERALS

1 Dishwasher
2 Body
21 Side wall
22 Side wall
23 Interior
3 Pull-out guide
31 Guide rail
32 Running rail
4 Pivot arm
5 Pivot arm
51 Web
52 Guide element
53 Locking pin
6 Guide adapter
61 First housing part
611 Recess
612 Window
62 Guide channel
63 Guide channel
64 Second housing part
65 Guide groove
66 Retaining element
67 Fastening element
69 Bolt receptacle
7 Locking plate
71 Locking groove
72 Locking recess
8 Unlocking device
81 Actuating element
82 Connecting lever
83 Web
84 Spring element
85 Unlocking element
851 First leg
852 Second leg
853 Pivot joint
85' Unlocking element
851' First leg
852' second leg
853' Base
854' Tongue
855' Retaining bolt receptacle
856' Joint receptacle
86 Clip
87 Bolt
88 Rotating cap
89 Retaining bolt
10 Shelf
11 Shelf
12 Side wall mounting
S1 First switch position
S2 Second switch position
A Pull-out direction
B Pivot axis

The invention claimed is:

1. A sliding-pivoting mechanism for a shelf of a piece of furniture or household appliance for pulling out and lifting the shelf from a body of the piece of furniture or household appliance, the sliding-pivoting mechanism comprising:

at least two pivot arms for pivotable fixing to the body, wherein the at least two pivot arms are arranged parallel to one another and form a parallel guide for a pall-oat guide, wherein the pull-out guide comprises at least one guide rail and a running ran wherein the running rail is displaceable relative to the guide rail and to which the shelf is fastened;

a locking mechanism arranged on the guide rail and on one of the pivot arms and configured to prevent simultaneous pivoting and sliding movement of the shelf, wherein the locking mechanism comprises a locking pin movably arranged on one of the at least two pivot arms, and a locking plate mounted in a stationary manner relative to the guide ran, wherein the locking plate and the locking pin cooperate in such a way that a pivoting of the pivot arms is blocked when the shelf is raised to an upper loading and unloading position; and an unlocking device coupled to the locking mechanism and having an actuating element and an unlocking element, with which the locking pin is moveable from a blocking position to a release position, wherein the actuating element is a handle that is tiltable about a horizontal pivot axis and is coupled to the unlocking element via a connecting lever, wherein the unlocking element is an L-shaped lever rotatably arranged on the connecting lever and having a first leg and a second leg oriented at an angle to the first leg; and wherein the locking pin is pressable out of a locking groove of the locking plate by tilting the unlocking element with the first leg.

2. The sliding-pivoting mechanism of claim 1, wherein the unlocking element is held at the intersection of the first and second legs via a pivot joint on the connecting lever.

3. The sliding-pivoting mechanism of claim 2, wherein the pivot joint of the unlocking element is held on a web of the connecting lever.

4. The sliding-pivoting mechanism of claim 2, wherein the second leg is coupled to a retaining element that is fixed to a guide adapter or to the shelf in such a way that during an unlocking movement of the connecting lever in which the pivot joint is moved linearly, the first and second legs are rotatable about the pivot joint.

5. The siding-pivoting mechanism of claim 1, wherein the unlocking device is held in a spring-loaded manner in a locking position.

6. The sliding-pivoting mechanism of daim 19, wherein a spring element held on the connecting lever is held on the guide adapter, wherein a spring force of the spring element counteracts a movement of the connecting lever out of the locking position.

7. The sliding-pivoting mechanism of daim 1, wherein a web extending at an angle to a section of the connecting lever extending along a side surface of the shelf is arranged on the connecting lever.

8. The sliding-pivoting mechanism of claim 1, wherein, in order to limit a tilting movement of the actuating element, the connecting lever, which is aligned parallel to the pivot axis of the actuating element, is held by at least one clip fastened to a web of the shelf.

9. The sliding-pivoting mechanism of claim 1, wherein a guide element is fixed to one of the at least two pivot levers and, when a pivoting movement is performed, the one of the at least two pivot levers is guided along a guide channel of a guide adapter fixed to the shelf.

10. A sliding-pivoting mechanism for a shelf of a piece of furniture or household appliance for pulling out and lifting the shelf from a body of the piece of furniture or household appliance, the sliding-pivoting mechanism comprising:

at least two pivot arms for pivotable fixing to the body, wherein the at least two pivot arms are arranged parallel to one another and form a parallel guide for a pull-out guide, wherein the pall-out guide comprises at least one guide rail and a running rail, wherein the running rail is displaceable relative to the guide rail and to which the shelf is fastened;

a locking mechanism arranged on the guide rail and on one of the pivot arms and configured to prevent simultaneous pivoting and sliding movement of the shelf, wherein the locking mechanism comprises a locking pin movably arranged on one of the at least two pivot arms, and a locking plate mounted in a stationary manner relative to the guide rail, wherein the locking plate and the locking pin cooperate in such a way that a pivoting of the pivot arms is blocked when the shelf is raised to an upper loading and unloading position; and an unlocking device coupled to the locking mechanism and having an actuating element and an unlocking element, with which the locking pin is moveable from a blocking position to a release position, wherein the actuating element is a handle that is tiltable about a horizontal pivot axis and is coupled to the unlocking element via a connecting lever, wherein the unlocking element is a U-shaped lever rotatably arranged on a guide adapter, wherein the U-shaped lever has a first leg and a second leg connected to the first leg via a base, wherein the locking pin is pressable out of a locking groove of the locking plate:

by tilting the unlocking element with a tongue extending from the base.

11. The sliding-pivoting mechanism of claim 10, wherein the unlocking element is held at the base near the first leg via a pivot joint, which is formed by a bolt, in a stationary but rotatable manner on the guide adapter.

12. The sliding-pivoting mechanism of claim 11, wherein a retaining bolt is arranged at a free end of the first leg, wherein the retaining bolt is coupled to a web of the connecting lever in such a way that, during an unlocking movement of the connecting lever, the unlocking element is tilted about the pivot joint into its unlocking position.

13. The sliding-pivoting mechanism of claim 10, wherein the unlocking device is held in a spring-loaded manner in a locking position.

14. The siding-pivoting mechanism of claim 13, wherein a spring element held on the connecting lever is held on the guide adapter, wherein a spring force of the spring element counteracts a movement of the connecting lever out of the locking position.

15. The siding-pivoting mechanism of claim 10, wherein a web extending at an angle to a section of the connecting lever extending along a side surface of the shelf is arranged on the connecting lever.

16. The sliding-pivoting mechanism of claim 10, wherein, in order to limit a tilting movement of the actuating element, the connecting lever, which is aligned parallel to the pivot axis of the actuating dement, is held by at least one clip fastened to a web of the shelf.

17. The sliding-pivoting mechanism of claim 10, wherein a guide element is fixed to one of the at least two pivot levers and, when a pivoting movement is carried out, the one of the at least two pivot levers is guided along a guide channel of a guide adapter fixed to the shelf.

18. A household appliance, comprising:

a body;

at least one shelf guided in the body by a sliding-pivoting mechanism, which comprises at least two pivot arms for pivotable fixing to the body, wherein the at least two pivot arms are arranged parallel to one another and form a parallel guide for a pull-out guide, wherein the pull-out guide comprises at least one guide rail and a running rail, wherein the running rail is displaceable relative to the guide rail and to which the shelf is fastened;

a locking mechanism arranged on the guide rail and on one of the pivot arms and configured to prevent simultaneous pivoting and sliding movement of the shelf, wherein the locking mechanism comprises a locking pin movably arranged on one of the at least two pivot arms, and a locking plate mounted in a stationary manner relative to the guide rail, wherein the locking plate and the locking pin cooperate in such a way that a pivoting of the pivot arms is blocked when the shelf is raised to an upper loading and unloading position; and an unlocking device coupled to the locking mechanism and having an actuating element and an unlocking element, with which the locking pin is moveable from a blocking position to a release position, wherein the actuating element is a handle that is tiltable about a horizontal pivot axis and is coupled to the unlocking element via a connecting lever, wherein the unlocking element is an L-shaped lever rotatably arranged on the connecting lever and having a first leg and a second leg oriented at an angle to the first leg, and the locking pin is pressable out of a locking groove of the kicking plate by tilting the unlocking element with the first leg, or wherein the unlocking element is a U-shaped lever rotatably arranged on a guide adapter, wherein the U-shaped lever has a first leg and a second leg connected to the first leg via a base, the locking pin is pressable out of a locking groove of the locking plate by tilting the unlocking element with a tongue extending from the base.

19. The household appliance of claim 18, wherein the household appliance is a dishwasher and the shelf is a dish rack.

* * * * *